United States Patent [19]

Stone et al.

[11] 4,212,562

[45] Jul. 15, 1980

[54] METHOD AND APPARATUS FOR LEVELING TEMPLATES FOR OFFSHORE SUBTERRANEAN WELLS

[75] Inventors: William B. Stone, Houston, Tex.; Marvin L. Holbert, Jr., Gretna, La.

[73] Assignee: Lynes, Inc., Houston, Tex.

[21] Appl. No.: 929,389

[22] Filed: Jul. 31, 1978

[51] Int. Cl.[2] ..... E02D 21/00; E02D 27/04

[52] U.S. Cl. ..... 405/195; 166/366; 175/7; 405/229; 248/673

[58] Field of Search ..... 405/196, 197, 198, 199, 405/229, 201, 202-209; 175/5, 7-9, 27; 166/368, 366; 248/23

[56] References Cited

U.S. PATENT DOCUMENTS

| | | | |
|---|---|---|---|
| 2,924,947 | 2/1960 | Peterson | 175/8 X |
| 2,944,403 | 7/1960 | Smith | 405/199 |
| 3,008,691 | 11/1961 | Steele et al. | 405/198 X |
| 3,171,259 | 3/1965 | Roussel | 405/199 |
| 3,513,910 | 5/1970 | Townsend | 175/9 X |
| 4,010,798 | 3/1977 | Corgnet | 175/9 X |
| 4,127,991 | 12/1978 | Regan | 175/7 X |

*Primary Examiner*—Dennis L. Taylor
*Attorney, Agent, or Firm*—William C. Norvell, Jr.

[57] ABSTRACT

A method and apparatus are disclosed for leveling a relatively massive template structure which is positionable on the ocean bottom in proximity to one or more sites of subterranean wells. Since the template is primarily utilized to mount or guide later applied drilling, completion or production equipment, it is essential that the template be positioned on its fixing piles in a precise horizontally level position. Accordingly, a plurality of sleeves are secured to the template which respectively loosely encircle the hollow fixing piles. Hydraulically operated clamp means are provided to lock the encircling sleeves at any selected vertical position to a respective fixing pile. A hydraulic elevating mechanism is lowered into the top open end of at least one such fixing pile and utilized to effect the lifting of the sleeve and adjacent portion of the template to which the sleeve is secured to a height approximating the desired level position. The lifting movements may be performed successively or simultaneously on each of the fixing piles so that the template is gradually brought into a precise level position as indicated by bubble or other level indicators mounted on or associated with the template, and the clamp means are permanently locked in their clamping position.

14 Claims, 7 Drawing Figures

METHOD AND APPARATUS FOR LEVELING TEMPLATES FOR OFFSHORE SUBTERRANEAN WELLS

BACKGROUND OF THE INVENTION

1. Field of the Invention

The invention relates to a method and apparatus for the leveling of a template at an offshore location and on an ocean or sea bed.

2. Description of the Prior Art

The demand for new sources of oil and gas in recent years has brought a dramatic increase in the amount of well drilling and completion on the ocean floor. Such wells are drilled at depths ranging from fifty to several thousand feet and a variety of techniques are employed to effect first the drilling of the well and then the installation of completion and production equipment to remove the hydrocarbons. Because of the substantial cost of installing a platform, particularly at increased water depths, drilling and completion operations are commonly performed from a drilling or other barge and at any one drilling site, a number of wells are concurrently drilled and incrementally completed. Since it may require from twelve to eighteen months to build and assemble in place an offshore platform, it is necessary, once the wells have been drilled and are capable of production, to provide means for capping each well during the intervening period, and also for connecting the well casings to the completion and production equipment once the drilling platform is ready to be installed. For these purposes, a template is utilized which comprises a relatively massive structure formed of welded tubing and involving a number of flotation tanks so that the bouyancy of the template can be controlled by alternately introducing water or air within the hollow interior of the template frame structure for the purpose of landing the template upon the ocean floor. Alternatively, the template may be installed on a plurality of fixing piles sunk in the ocean floor and the well drilling, completion or production equipment mounted on the template. In either event, it is essential that the template be positioned in a precisely level or horizontal position so that cable guide bushings and other sleeves provided on the template will permit down hole drilling, completion or production equipment to pass therethrough and into accurate alignment with the well bores.

It is difficult to drill and mount in cement in the ocean floor at least three fixing piles in a precisely vertical position. Instead, the piles are mounted in drilled bores and cemented therein in as nearly an upright position as is possible, and then cooperating sleeves rigidly secured to the template in the same horizontal spacing as the fixing piles, which sleeves are several inches larger in internal diameter than the fixing piles, are slipped freely over such piles regardless of any minor misalignments in the vertical inclination of the fixing piles.

It previously was necessary to secure each of the encircling sleeves to the fixing piles by cement, with the template disposed in exactly a horizontal position, and, considering the fact that the size of the template may range up to one hundred feet per side and the mass of the template may be on the order of one hundred tons, this leveling operation has been a matter of some difficulty to accomplish by divers and has required an inordinate amount of diving time in order to achieve the level positioning of the template, and then the cementing of the template to the fixing piles in a precisely level position. Moreover, when it became desirable to abandon the particular well site, the recovery of the template was very difficult, because it could only be accomplished by underwater cutting operations since the mounting sleeves were rigidly attached to the fixing piles by cement or grout. Also, due to the low shear strength of the hardened grout, the sleeves were required to be very long which interfered with the jacket placement over the template.

Further details concerning prior uses and mountings of templates may be found in U.S. Pat. Nos. 3,612,177 and 3,618,661.

There is an apparent need, therefore, for an improved method and apparatus for effecting the leveling and securement of a template to its fixing piles on the ocean bed involving a minimum amount of diver involvement in the positioning operation.

SUMMARY OF THE INVENTION

The invention provides a template having a mounting sleeve for each fixing pile, and on each mounting sleeve encircling the fixing pile, a radially movable, hydraulically operated locking or clamping device. Additionally, the invention contemplates the insertion into the top open end of each fixing pile of a self-contained hydraulic cylinder and piston unit, which requires connection by the diver of only a pair of straps to a portion of the template adjacent the encircling sleeve.

Pressured hydraulic fluid applied to the piston will then effect the raising of the particular sleeve and adjacent portion of the template relative to the fixing pile encircled by such sleeve. When the first sleeve is raised to the approximate position required for leveling, as indicated by reference marks on the end of the pile projecting out of the sleeve, the radial locking mechanism is actuated to temporarily clamp the sleeve to the pile at that particular position. If the template is not leveled simultaneously by all of the hydraulic cylinders, the hydraulic cylinder may be moved successively to each of the other fixing piles and respective encircling sleeves on the template and a similar raising movement of each encircling sleeve and adjacent portion of the template is accomplished until the entire template has been raised to a level position as indicated by bubble indicators, or the like.

Since divers are required to make only simple connections of lifting straps from the lifting cylinder unit to the template, and hydraulic hoses to various detachable connector means provided on the encircling sleeves for controlling the clamping and locking mechanisms, it is apparent that the invention minimizes the amount of time required of the divers and floating equipment required to install the template, thus greatly reducing the time and expense of the entire template leveling operation.

Further objects and advantages of this invention will be apparent from the following detailed description taken in conjunction with the drawings and claims, which follow.

FIG.. 4 is a perspective view illustrating the insertion of a hydraulic lifting cylinder into one of the fixing piles.

Figure 5:
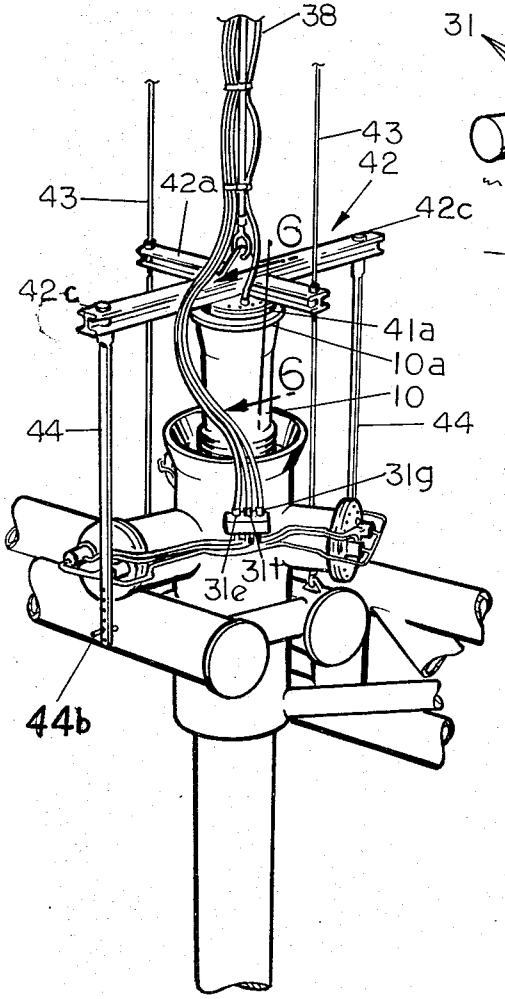
Figure 4:
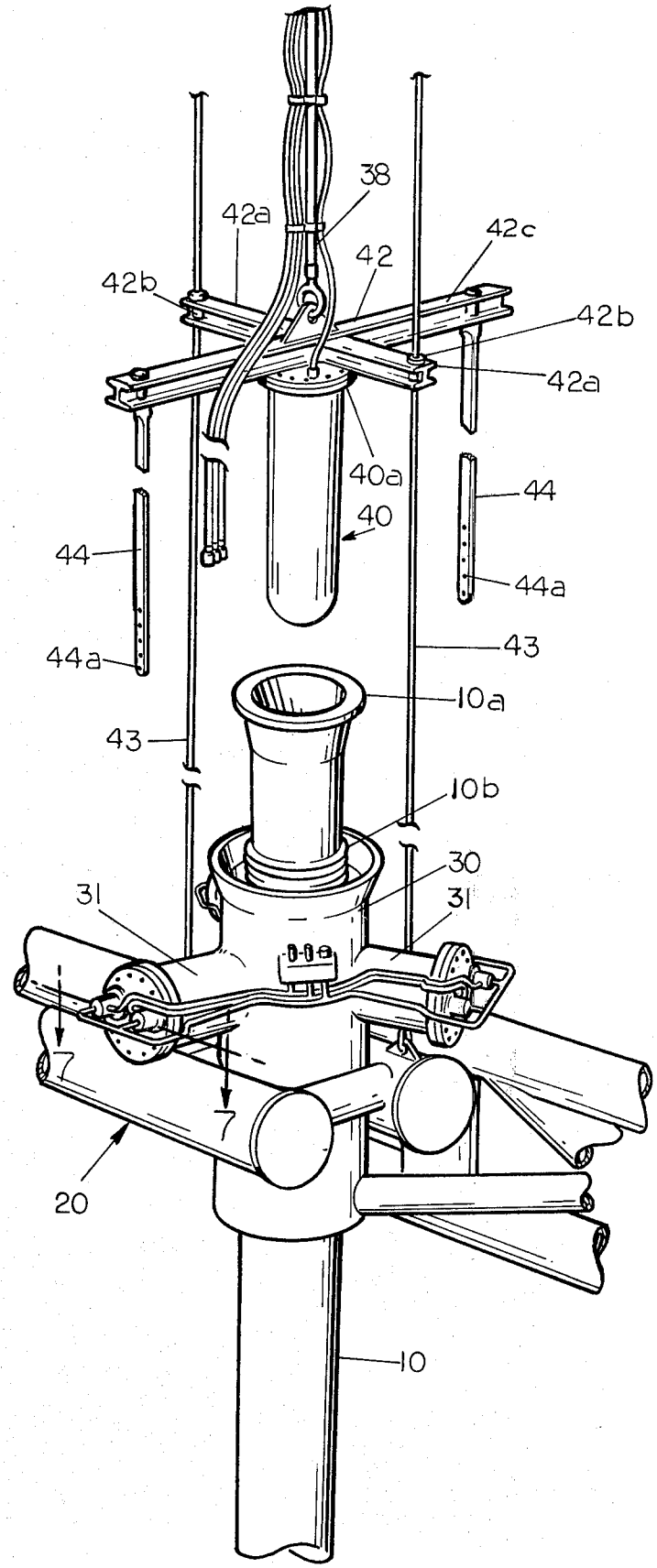

FIG. 5 is a view similar to FIG. 4 showing the hydraulic lifting cylinder completely inserted and assembled in the fixing pile, and connected to the adjacent portion of the template for effecting a lifting operation on such portion.

Figure 6:
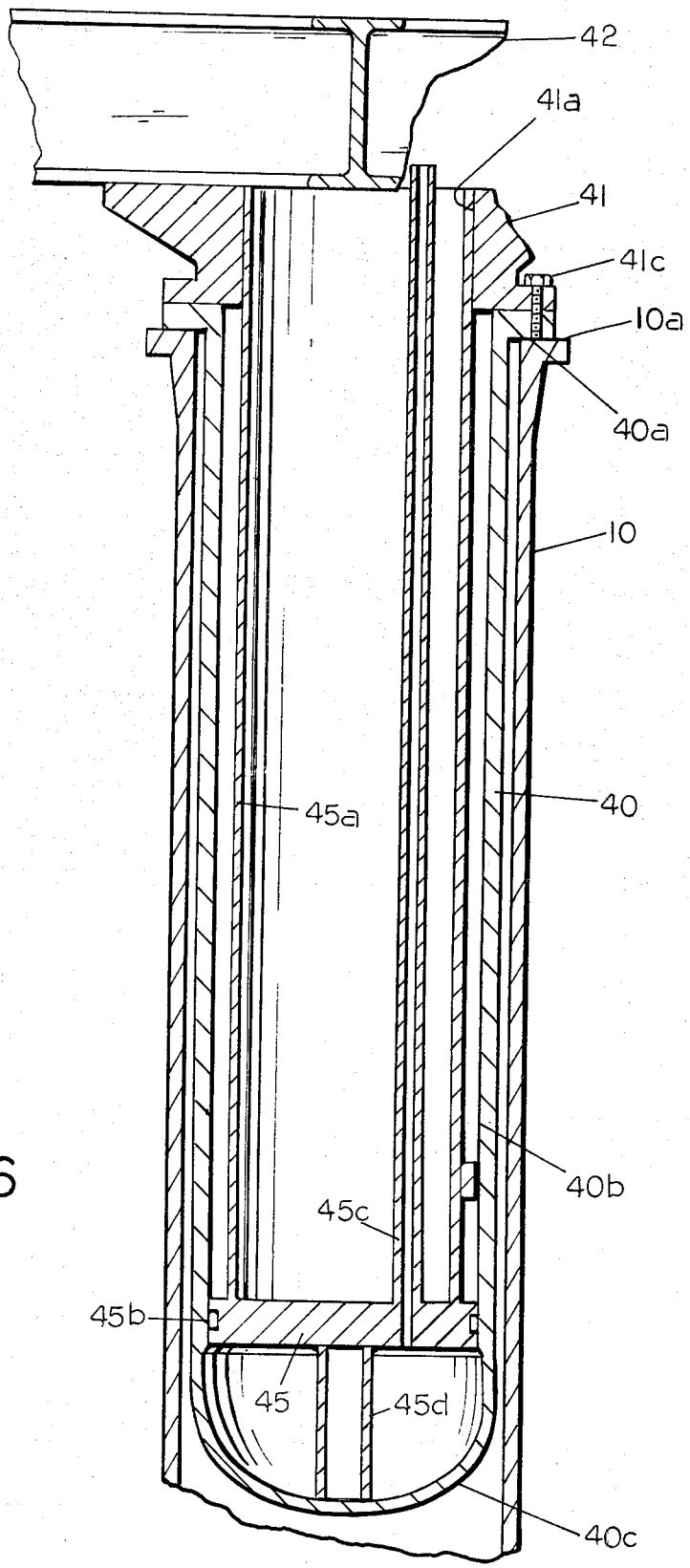

FIG. 6 is a partial vertical sectional view of FIG. 5 taken on Line 6—6 thereof.

Figure 7:
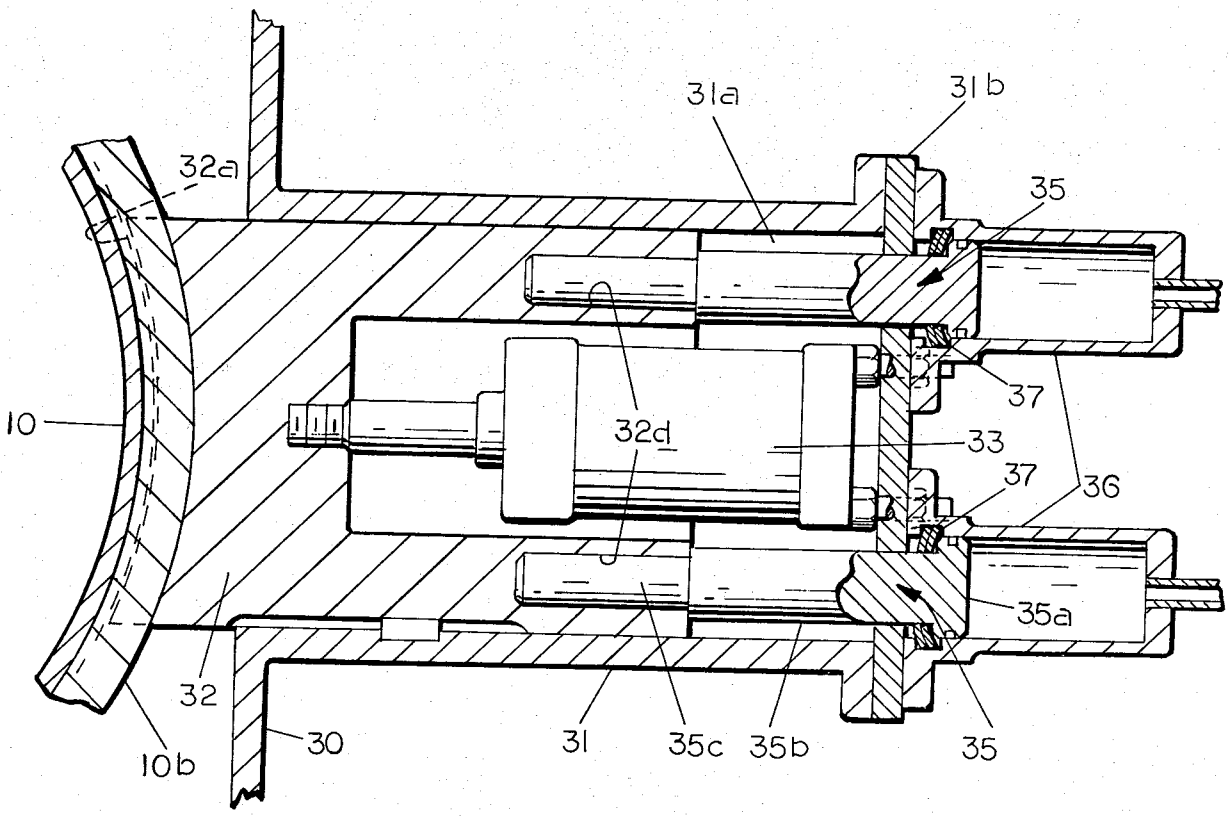

FIG. 7 is an enlarged scale sectional view taken on Line 7—7 of FIG. 4.

DESCRIPTION OF THE PREFERRED EMBODIMENTS

Figure 1:
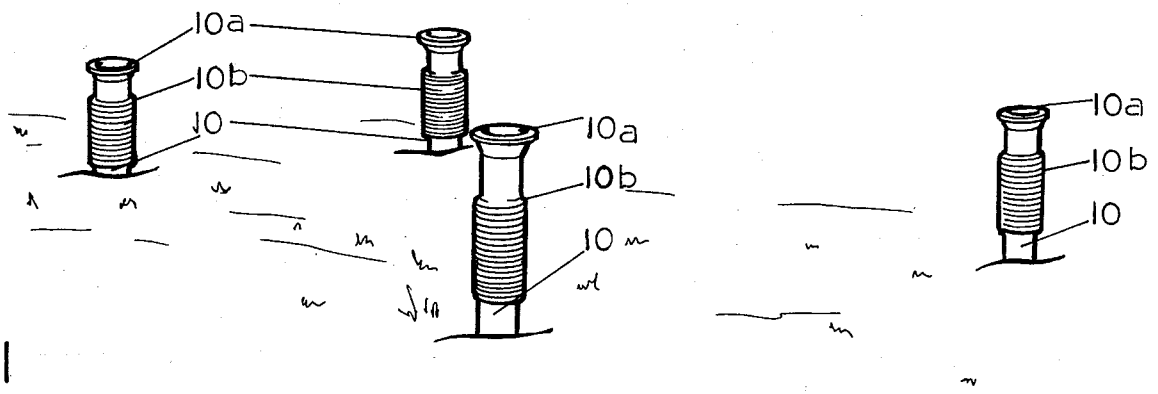
FIG. 1 is a perspective view showing a plurality of fixing piles mounted in the ocean floor.

Referring to FIG. 1, a plurality of fixing piles 10 are mounted in a substantially vertical position in the ocean floor adjacent the site of one or more well bores (not shown). The fixing piles 10 may be inserted in the ocean floor by any one of several conventional methods, such as, for example, by the methods described in U.S. Pat. No. 3,621,910 to Sanford, et al. Each fixing pile 10 comprises a hollow tubular structure, the lower end of which is cemented in a bore in the ocean floor. The top projecting end of each fixing pile is provided with a radial flange 10*a*, and a vertically corrugated portion 10*b* is rigidly secured to the pile below the flange 10*a*. Corrugated portion 10*b* may, if desired, be formed from two semi-cylindrical corrugated stampings which are welded together in assembled position on the particular pile.

Figure 2:
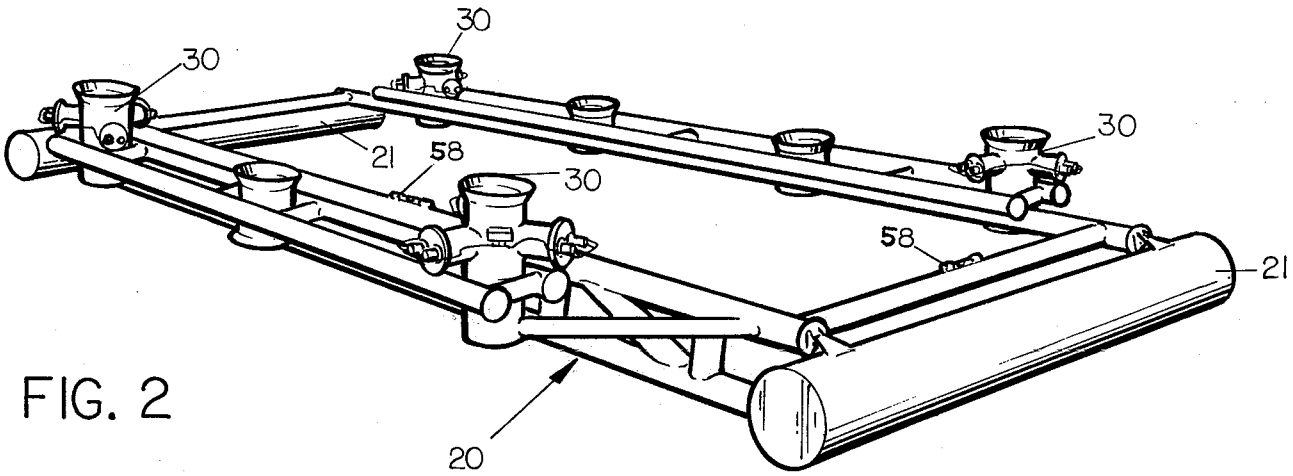
FIG. 2 is a perspective view of a typical template constructed in accordance with this invention.

Referring now to FIG. 2, a typical template 20 is shown comprising a generally rectangular structure formed by the welding together of metallic tubular sections. The particular shape of the template is immaterial, and may be triangular, pentagonal, or circular, so long as it roughly corresponds with the area in the ocean floor in which a plurality of well bores are to be drilled, or which have already been drilled, prior to the installation of the template.

In addition to the main body of the template 20 being formed of hollow tubular members, thus forming trapped air chambers, a pair of flotation tanks 21 may be welded to opposite ends of the template 20 which, when filled with air, provides sufficient flotation for the template 20 to permit it to float and to be towed to its location, following which the air is bled from the tanks and/or frame, and replaced by water, permitting the template to settle to the ocean floor.

Until the template is finally established in a level position on the fixing piles 10, a significant amount of compressed air may be retained in the flotation tanks 21 so as to minimize the underwater dead load of the template during the leveling operation. In any event, the template structures embodying this invention normally are of comparatively massive configuration and their linear dimensions may well be on the order of 100 feet per side, representing a structure that cannot be conveniently handled by one or more divers, particularly when installing the template at significant ocean depths.

It is assumed, to simplify the description of a preferred embodiment of this invention, that the fixing piles have been located in the ocean floor prior to the lowering of the template thereon. As a practical matter, the template could be laid on the ocean floor and the respective bores for the fixing piles drilled through fixing sleeves 30 respectively provided on the template 20 in a desired location with respect to the well sites. The fixing piles can then be lowered through the fixing sleeves 30 and cemented in the ocean bottom, whereafter the leveling operations embodying this invention can thereafter be performed.

Figure 3:
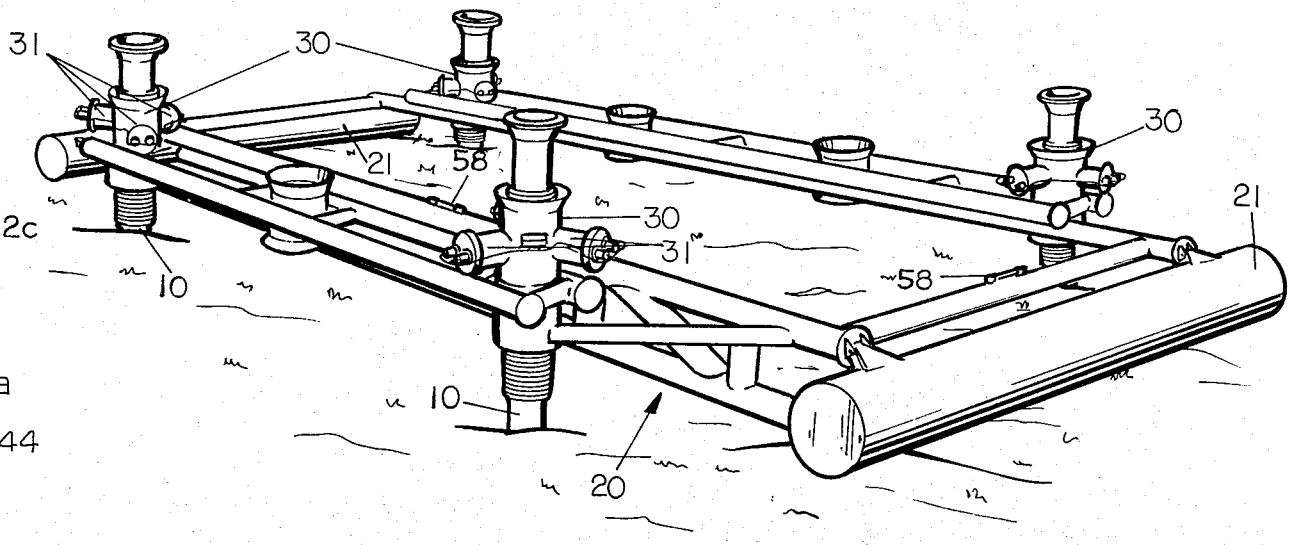
FIG. 3 is a perspective view showing the template of FIG. 2 initially mounted on the fixing piles.

Each fixing sleeve 30 is welded to the template in a horizontal location corresponding to the location of one of the fixing piles 10. Each sleeve is of substantially larger internal diameter than the exterior of the corresponding fixing pile, and, hence, the template may be readily lowered with each sleeve 30 encircling one of the fixing piles 10, as shown in FIG. 3. This does not, however, provide a sufficient leveling of the template 20 to satisfy the precise alignment requirements of the drilling, production and/or completion equipment which is subsequently connected through the template to the various wells drilled beneath the area covered by the template.

Referring particularly to FIGS. 4 and 7, it is seen that each fixing sleeve 30 is provided with three circumferentially spaced cylindrical protuberances 31, each defining a radial cylinder chamber 31*a* for the mounting of a radially shiftable clamping head 32. The inner end of clamping head 32 is provided with vertical corrugations 32*a* corresponding to the shape of the corrugated portion 10*b* of the fixing piles 10, and, when one or more of the clamping heads 32 are moved radially inwardly to engage the adjacent corrugated portion 10*b* of the respective fixing pile 10, it is apparent that the fixing sleeve 30 will be locked in a particular vertical position relative to the fixing pile 10. The clamping head 32 is radially shifted by a double acting hydraulic cylinder 33 which is mounted cencentrically within the bore 31*a* of the cylindrical protuberance 31 and suitably secured to an end plate 31*b* of protuberance 31.

Each clamping head 32 is provided with a mechanism for permanently locking it in its clamping position. Such mechanism comprises a pair of diametrically disposed locking pistons 35 which are respectively slidably mounted in a pair of cylinders 36 mounted on the radially outer face of the end wall 31*b* by a plurality of bolts (not shown). Each piston 35 has an enlarged head portion 35*a*, and a reduced diameter rod portion 35*b* which passes through end wall 31*b* which is suitably bolted to the end face of cylindrical protuberance 31. Adjacent the end wall 31*b* are a plurality of cone shaped washers 37 which readily permit the inward passage of the cylindrical rod portions 35*b* of pistons 35, but prevent any reverse movement of such pistons. Hence, the movement of the locking pistons 35 is essentially unidirectional in nature. Once they have been moved radially inwardly through the application of hydraulic pressure to the interior of the cylinder 36, they will be mechanically locked in that position until the entire mechanism is disassembled from end wall 31*b*. In the radially inward locking position, a still further reduced diameter end rod 35*c* of the piston 35 slidably engages a suitable aperture 32*d* provided in the clamping head 32, and the shoulder formed between portions 35*b* and 35*c* of the locking piston 35 forms an effective stop against any radially outward movement of the clamping head 32. Additionally, the end portions 35*c* insure that the corrugated portion 32*a* of the clamping head 32 will be maintained in a correct angular orientation by preventing appreciable rotation from vertical of the head 32, to accurately align with the corrugations on corrugated portion 10*b* of the respective fixing pile 10.

Until the locking pistons 35 are actuated, however, the double acting cylinder 33 can move the clamping head 32 radially inwardly and back out again to permit successive engagements and disengagements of the clamping head 32 with the corrugated portion 10*b* of the fixing pile 10.

When it is desired to adjust the position of the template 20 relative to a particular fixing pile, obviously, the clamping heads 32 would be in their retracted or radially outward position so as to permit free vertical movement of the fixing sleeves 30 relative to the fixing piles 10.

After a particular fixing sleeve 30 is moved vertically to a new position, the cylinders 33 are actuated by application of fluid pressure thereto to move the clamping heads 32 inwardly and lock the particular fixing sleeve 30 in the selected vertical position on the corrugated portion 10*b* of the respective fixing pile 10.

Referring now to FIGS. 4, 5, and 6, a self-contained hydraulically actuated lifting cylinder 40 is provided, which is suspended from the drilling barge or other floating vessel proximated on the ocean by a cable 38. Intermediate the cable 38 and the hydraulic lifting cylinder 40 there is provided a cruciform frame structure 42 formed by welding together of two I beams. Two opposed arms 42*a* of such structure are provided with vertical guide bushings 42*b* which respectively slidably engage guide cables 43 extending from suitable mountings on the template 20 to the barge or vessel on the ocean surface. The other two arms 42*c* of cruciform structure 42 pivotally mount in depending relationship a pair of connecting links 44 having a plurality of vertically spaced holes 44*a* therein to permit the convenient detachable connection of such arms by a diver to a portion of the template 20 adjacent the particular fixing sleeve 30, for example, by the insertion of manually actuated locking pins 44*b* through the apertures 44*a* and appropriate apertures (not shown) in the framework of the template 20. In any event, the cylinder unit 40 may be inserted into the top open end of the respective fixing pile 10 in the manner illustrated in FIG. 5 with a radial flange 40*a* of the cylinder unit 40 resting upon the radial end face 10*a* of the fixing pile 10.

Referring now to FIG. 6, it will be seen that each hydraulic cylinder unit 40 comprises a centrally apertured mounting bushing 41 supporting a cylinder sleeve 40*b* by being secured thereto by a plurality of circumferentially spaced bolts 41*c* passing through adjacent flanges provided on the end faces of the bushing 41 and the sleeve 40*b*. Sleeve 40*b* has a closed semi-spherical end 40*c*.

The inner surface 41*a* of bushing 41 also slidably mounts a hollow tubular piston shaft 45*a* of a piston head 45. Piston head 45 is provided with an appropriate gasket 45*b* to sealingly engage the interior wall of the cylinder sleeve 40*b*. Hydraulic fluid is passed downwardly through the piston shaft 45*a* and piston head 45 through an appropriate pipe 45*c*. A tubular stop 45*d* is welded to the end face of piston 45 in coaxial, downwardly projecting relationship, so as to prevent the piston head 45 from entering the spherical end portion 40*c* of the cylinder sleeve 40*b*. The top end of the piston shaft 45*a* abuts the juncture of the cruciform frame structure 42.

It follows, therefore, that the introduction of pressured hydraulic fluid into cylinder unit 40 through the tube 45*c* will produce an upwardly directed force on the cruciform frame structure 42 and, thus, effect a lifting of the adjacent portion of the template 20 by virtue of the detachable connection of the depending links 44 between such cruciform frame structure and the template.

OPERATION

After the initial positioning of the template 20 on the fixing piles 10 as illustrated in FIG. 3, the hydraulic cylinder unit 40 is lowered from the barge or other surface vessel in the manner illustrated in FIG. 4 and inserted within the top open end of one of the fixing piles 10. The depending links 44 are detachably connected by a diver to an adjacent portion of the template 20 and the same diver makes the necessary detachable hydraulic hose connections to the clamping mechanism as indicated schematically by connectors 31*e*, 31*f* and 31*g*. The same diver then releases a safety pin (not shown) that has held the mounting bushing 41 and the shaft 45*a* together to prevent the cylinder from extending.

Pressured hydraulic fluid is then applied to hydraulic unit 40 by a hose connection to pipe 45*c* and a raising of the portion of the template 20 to which the links 44 are detachably connected results. Previously, the approximate height of the top of each fixing sleeve 30 relative to the encircled fixing pile 10 to achieve a level position, can be readily computed, and rough vertical graduation marks (not shown) can be applied to the exposed portion of each fixing pile 10. Hence, the fixing sleeve 30 to which the hydraulic unit 40 is attached is raised to the approximate vertical position required for the level position of the template, and then hydraulic pressure is applied to the clamping cylinders 33 to drive the clamping heads 32 radially inwardly to engage the corrugated portion 10*b* of the respective fixing pile 10 and lock the encircling fixing sleeve 30 to such fixing pile. Hydraulic fluid is, however, not applied to the locking cylinders 36 until it is certain that the template has achieved a level position.

Subsequently, the hydraulic fluid is released from the cylinder unit 40 and such unit is disconnected by the diver from the template 20, and the entire unit moved into vertical alignment with the next one of fixing sleeves 30 where the raising operation to approximately the desired position is repeated. If the template is not leveled simultaneously by all of the hydraulic cylinders, this sequence of operations is repeated for each of the fixing sleeves 30 so that the template is placed in a position which, by reference to the graduation marks on the fixing piles 10, will be approximately level.

The exact level position of the template 20 may be determined by either a diver or an underwater camera observing a plurality of bubble-type level indicators 58 provided around the perimeter of the template 20, or by any other means readily available and known to those skilled in the art. If the template is still not exactly level, the diver then connects the hydraulic lifting unit 40 to the particular fixing sleeve or sleeves 30 where additional height of the template is required and a small vertical adjustment of the height of the template relative to that fixing pile is effected. This procedure may have to be repeated on several of the other fixing piles but, in the end, an exactly level position of the template 20 should be achievable. At this point, the diver makes a hydraulic connection to the detachable connector 31*g* which supplies pressured fluid to the locking cylinders 36. Locking pistons 35 are driven radially inwardly to lock the clamping heads 32 in their engaged positions with the corrugated portion 10*b* of the respective fixing pile 10, and the washers 37 prevent any retractive movement of the locking pistons 35 even though all hydraulic pressure is subsequently removed from the clamping cylinder 33 and the locking cylinders 36. Thus, the template 20 will be mechanically locked in the desired level position on the fixing piles 10 and will not be disturbed by the removal of the hydraulic lines from the detachable connectors.

From the foregoing description, it is apparent that the described method and apparatus is completely capable of permitting the leveling of a relatively massive template by a single diver in a minimum amount of underwater time. This capability significantly decreases the cost of a template installation. Once installed, the template is mechanically locked in the desired level position and drilling equipment may be lowered to be positioned in exact alignment with the desired drilling sites or, after the wells have been drilled, completion and/or production equipment may be guided to a proper vertical alignment connection with the drilled wells.

The template embodying the locking mechanism herein described has a further advantage in that it is completely recoverable. A diver need only remove the bolts which hold the locking cylinders 36 in place and the clamping heads 32 can be radially shifted outwardly to disengage from their respective fixing pile. The hydraulic cylinder unit 40 is obviously recoverable, and may be used for an unlimited number of template installations.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. Apparatus for leveling a template for use in the drilling, completion or workover of a deep water, subterranean well on a plurality of horizontally spaced hollow piles secured in a vertical position in the ocean floor, comprising: a plurality of vertically disposed sleeves secured to the template at horizontal locations corresponding to said piles, said sleeves having an internal diameter exceeding said piles, permitting each sleeve to be respectively freely passed downwardly over the top ends of said piles; (the top ends of said piles respectively having vertically corrugated surfaces respectively surrounded by said sleeves;) at least one radially shiftable clamp mounted on each said sleeve, said clamp having its inner face engagable with (said vertically corrugated) the adjacent surface portion of the respective pile to lock each said sleeve to the respective pile in any selected one of a plurality of vertical positions; means removably insertable in the top end of each pile and detachably connected to the respective sleeve for raising each said sleeve relative to the enclosed pile to achieve a horizontally level position of the template; and hydraulically activated operating means for radially shifting each said clamp inwardly to lock the respective sleeve in the pre-selected vertical position on its co-operating pile required to level the template.

2. The apparatus of claim 1 wherein said removably insertable means for raising each sleeve relative to the enclosed pile comprises a hydraulic cylinder unit axially insertable within the top end of said pile with the cylinder portion abutting the end face of the pile and the piston rod projecting out of the top of said pile, means for detachably connecting said piston rod to the template adjacent said sleeve, and means for supplying pressured hydraulic fluid to the bottom face of said piston to raise said sleeve relative to said encircled pile.

3. The apparatus defined in claim 1 or 2 additionally comprising means for permanently locking each said clamp in its engaged position with the respective pile after said template is leveled.

4. The method of leveling a template in position on the ocean floor adjacent to the site of one or more drilled well bores, said template having vertical axis sleeves respectively loosely surrounding a plurality of vertical tubular fixing piles embedded in the ocean floor, comprising the steps of: (a) inserting a hydraulic cylinder unit having a piston element within the top end of the first pile, with the cylinder resting on the pile; (b) detachably connecting the upper portion of the piston element of the hydraulic cylinder unit to the template immediately adjacent the respective sleeve; (c) introducing pressured hydraulic fluid beneath said piston element to cause same to gradually lift the adjacent portion of the template; (d) observing the amount of said elevation and stopping same when that portion of the template approached its desired position; (e) locking said respective sleeve to the encircled pile in the desired position; (f) detaching said hydraulic piston unit from the template and removing same from said first pile; and (g) moving the hydraulic cylinder unit successively to each of the remaining piles and repeating steps (a) through (f) until the entire template is elevated to the desired level position.

5. The method of leveling a template positioned on the ocean floor adjacent to the site of one or more drilled well bores, said template having vertical axis sleeves respectively loosely surrounding a plurality of vertical tubular fixing piles embedded in the ocean floor, comprising the steps of: (a) inserting a hydraulic cylinder unit having a piston element within the top end of a first pile with the cylinder resting on the pile; (b) detachably connecting the upper portion of the piston element of the hydraulic cylinder unit to the template immediately adjacent the respective sleeve; (c) introducing pressured hydraulic fluid beneath said piston element to cause same to gradually lift the adjacent portion of the template; (d) observing the amount of said elevation and stopping same when that portion of the template approached its desired position; (e) temporarily clamping said respective sleeve to the encircled pile in the desired position; (f) detaching said hydraulic cylinder unit from the template and removing same from said first pile; (g) moving the hydraulic cylinder unit successively to each of the remaining piles and repeating steps (a) through (f) until the entire template is elevated to the desired level position; and (h) permanently locking said sleeves to said respective encircled piles.

6. Apparatus for leveling a template for use in the drilling, completion or workover of a deep water, subterranean well on a plurality of horizontally spaced hollow piles secured in a vertical position in the ocean floor, comprising: a plurality of vertically disposed sleeves secured to the template at horizontal locations corresponding to said piles, said sleeves having an internal diameter exceeding said piles, permitting each sleeve to be respectively freely passed downwardly over the top ends of said piles; the top ends of said piles respectively surrounded by said sleeves; at least one radially shiftable clamp mounted on each said sleeve, said clamp having its inner face engagable with said vertically corrugated surface portion of the respective pile to lock each said sleeve to the respective pile in any selected one of a plurality of vertical positions; removable means successively insertable in the top end of each pile for raising each said sleeve relative to the enclosed pile to achieve a horizontally level position of the template; and fluid activated operating means for radially shifting each said clamp inwardly to lock the respective sleeve in the pre-selected vertical position on its cooperating pile required to level the template.

7. The apparatus of claim 8 wherein said removable means for raising each sleeve relative to the enclosed pile comprises a fluid cylinder unit axially insertable within the top end of said pile with the cylinder portion abutting the end face of the pile and the piston rod projecting out of the top of said pile, means for detachably connecting said piston rod to the template adjacent said sleeve, and means for supplying pressured fluid to the bottom face of said piston to raise said sleeve relative to said encircled pile.

8. The apparatus defined in claim 6 or 7 additionally comprising means for permanently locking each said clamp in its engaged position with the respective pile after said template is leveled.

9. The method of leveling a template in position on the ocean floor adjacent to the site of one or more drilled well bores, said template having vertical axis sleeves respectively loosely surrounding a plurality of vertical tubular fixing piles embedded in the ocean floor, comprising the steps of: (a) inserting a fluid activated cylinder unit having a piston element within the top end of the first pile, with the cylinder resting on the pile; (b) detachably connecting the upper portion of the piston element of the fluid activated cylinder unit to the template immediately adjacent the respective sleeve; (c) introducing pressured fluid beneath said piston element to cause same to gradually lift the adjacent portion of the template; (d) observing the amount of said elevation and stopping same when that portion of the template approached its desired position; (e) locking said respective sleeve to the encircled pile in the desired position; (f) detaching said cylinder unit from the template and removing same from said first pile; and (g) moving the hydraulic piston unit successively to each of the remaining piles and repeating steps (a) through (f) until the entire template is elevated to the desired level position.

10. The method of leveling a template positioned on the ocean floor adjacent to the site of one or more drilled well bores, said template having vertical axis sleeves respectively loosely surrounding a plurality of vertical tubular fixing piles embedded in the ocean floor, comprising the steps of: (a) inserting a fluid activated cylinder unit having a piston element within the top end of a first pile with the cylinder resting on the pile; (b) detachably connecting the upper portion of the piston element of the fluid activated cylinder unit to the template immediately adjacent the respective sleeve; (c) introducing pressured fluid beneath said piston element to cause same to gradually lift the adjacent portion of the template; (d) observing the amount of said elevation and stopping same when that portion of the template approached its desired position; (e) temporarily clamping said respective sleeve to the encircled pile in the desired position; (f) detaching said cylinder unit from the template and removing same from said first pile; (g) moving the cylinder unit successively to each of the remaining piles and repeating steps (a) through (f) until the entire template is elevated to the desired level position; and (h) permanently locking said sleeves to said respective encircled piles.

11. Apparatus for leveling a template for use in the drilling, completion or workover of a deep water, subterranean well on a plurality of horizontally spaced hollow piles secured in a vertical position in the ocean floor, comprising: a plurality of vertically disposed sleeves secured to the template at horizontal locations corresponding to said piles, said sleeves having an internal diameter exceeding said piles, permitting each sleeve to be respectively freely passed downwardly over the top ends of said piles; the top ends of said piles respectively having vertically corrugated exterior surfaces respectively surrounded by said sleeves; at least one radially shiftable clamp mounted on each said sleeve, said clamp having its inner face engagable with said vertically corrugated surface portion of the respective pile to lock each said sleeve to the respective pile in any selected one of a plurality of vertical positions; means for raising each said sleeve relative to the enclosed pile to achieve a horizontally level position of the template; hydraulically activated operating means for radially shifting each said clamp inwardly to lock the respective sleeve in the preselected vertical position on its cooperating pile required to level the template; said means for raising each sleeve relative to the enclosed pile comprising: a hydraulic cylinder unit positionable axially with respect to the top end of said pile with the cylinder portion abutting the end face of the pile and the piston rod projecting out of the top of said pile; means for detachably connecting said piston rod to the template adjacent said sleeve; and means for supplying pressured hydraulic fluid to the bottom face of said piston to raise said sleeve relative to said encircled pile.

12. The method of leveling a template in position on the ocean floor adjacent to the site of one or more drilled well bores, said template having vertical axis sleeves relatively loosely surrounding a plurality of vertical tubular fixing piles embedded in the ocean floor, comprising the steps of: (a) inserting a plurality of hydraulic cylinder unit means respectively within the top ends of a plurality of said piles, with each cylinder means resting on the respective piles; each such cylinder means having (a) an upwardly projecting piston element; (within the top end of a plurality of said piles, with the cylinder means resting on the respective piles;) (b) detachably connecting the upper portion of the piston element of the hydraulic cylinder unit means to the template immediately adjacent the respective sleeve; (c) introducing pressured hydraulic fluid beneath each said piston element to cause same to gradually lift the template; (d) observing the amount of said elevation and stopping same when the template approaches its desired position; (e) locking said respective sleeve to the encircled pile in the desired position; and (f) detaching said hydraulic cylinder means from the template and removing same from the respective piles.

13. The method of leveling a template in position on the ocean floor adjacent to the site of one or more drilled well bores, said template having vertical axis sleeves relatively loosely surrounding a plurality of vertical tubular fixing piles embedded in the ocean floor, comprising the steps of: (a) axially positioning a hydraulic cylinder unit having a piston element with respect to the top end of the first pile, with the (piston element) cylinder resting on the pile; (b) detachably connecting the upper portion of the piston element of the hydraulic cylinder unit to the template immediately adjacent the respective sleeve; (c) introducing pressured hydraulic fluid beneath said piston element to cause same to gradually lift the adjacent portion of the template; (d) observing the amount of said elevation and stopping same when that portion of the template approaches its desired position; (e) locking said respective sleeve to the encircled pile in the desired position; (f) detaching said hydraulic cylinder unit from the template and removing same from said first pile; and (g) moving the hydraulic cylinder unit successively to each of the remaining piles and repeating steps (a) through (f) until the entire template is elevated to the desired level position.

14. The method of leveling a template in position on the ocean floor adjacent to the site of one or more drilled well bores, said template having vertical axis sleeves respectively loosely surrounding a plurality of vertical tubular fixing piles embedded in the ocean floor, comprising the steps of: (a) inserting a fluid activatable cylinder unit means (, each such cylinder unit means having a piston element,) within the top end of one of a plurality of said piles; each such cylinder unit means having a piston element; (b) detachably connecting the upper portion of the piston element of the fluid activatable cylinder unit means to the template immediately adjacent the respective sleeve; (c) introducing pressured fluid beneath each said piston element to cause same to gradually lift the template; (d) observing the amount of said elevation and stopping same when said template approaches its desired position; (e) locking said respective sleeve to the encircled pile in the desired position; and (f) detaching the said fluid activatable cylinder unit means from the template and removing same from the one pile.

* * * * *